US007347789B2

(12) United States Patent
Patterson

(10) Patent No.: US 7,347,789 B2
(45) Date of Patent: Mar. 25, 2008

(54) GOLF PUTTING PRACTICE DEVICE

(76) Inventor: Owen M. Patterson, 21223 Mire Dr., Abita Springs, LA (US) 70420

( * ) Notice: Subject to any disclaimer, the term of this patent is extended or adjusted under 35 U.S.C. 154(b) by 593 days.

(21) Appl. No.: 10/438,053

(22) Filed: May 15, 2003

(65) Prior Publication Data

US 2003/0190970 A1 Oct. 9, 2003

Related U.S. Application Data

(63) Continuation of application No. PCT/US01/43161, filed on Nov. 27, 2001.

(60) Provisional application No. 60/253,002, filed on Nov. 27, 2000.

(51) Int. Cl.
*A63B 69/36* (2006.01)

(52) U.S. Cl. ..... 473/180

(58) Field of Classification Search ..... 473/172–189, 473/191, 164; D21/789
See application file for complete search history.

(56) References Cited

U.S. PATENT DOCUMENTS

| | | | |
|---|---|---|---|
| 1,287,903 | A | 12/1918 | Daily |
| 1,510,239 | A | 9/1924 | Monosmith |
| 1,682,601 | A | 8/1928 | Cunningham |
| 1,691,935 | A | 11/1928 | Paterson |
| 1,823,487 | A | 9/1931 | Clear |
| 2,283,462 | A | 5/1942 | Richie |
| 2,933,318 | A | 4/1960 | Boynton |
| 3,341,207 | A | 9/1967 | Shusda |
| 3,451,682 | A | 6/1969 | Trimble |
| D245,306 | S | 8/1977 | Ryden et al. |
| 4,906,006 | A | 3/1990 | Sigunick |
| 5,013,042 | A | 5/1991 | Garnes |
| 5,131,658 | A | 7/1992 | Grenon |
| 5,257,808 | A | 11/1993 | Mueller et al. |
| 5,275,404 | A | 1/1994 | Dimaano et al. |
| 5,487,545 | A | 1/1996 | Schindler |
| 5,735,751 | A | 4/1998 | Pacheco |
| D405,144 | S | 2/1999 | Crum |
| 5,997,406 | A | 12/1999 | Selton |
| 6,279,245 | B1 | 8/2001 | Johnsen |

*Primary Examiner*—Mark S Graham
(74) *Attorney, Agent, or Firm*—Shlesinger, Arkwright & Garvey LLP

(57) ABSTRACT

A golf putting practice device comprising a disc, the disc having an annular top portion and an annular bottom portion, the annular top portion having a top edge and the annular bottom portion having a bottom edge, the annular top and bottom portions forming an outer annular peripheral edge, the disc optionally provided with a central opening extending through from the top edge to the bottom edge, the central opening at the top edge having a diameter substantially greater than the central opening at the bottom edge and the outer annular peripheral edge projecting between the bottom edge and the top edge and spaced a substantial distance from said top and bottom edges.

4 Claims, 3 Drawing Sheets

GOLF PUTTING PRACTICE DEVICE

RELATED APPLICATIONS

This is a continuation of International Application No. PCT/US01/43161 having an international filing date of Nov. 27, 2001, published in English under PCT Article 21(2) and now abandoned.

FIELD OF THE INVENTION

The present invention relates to a device for practicing golf and more particularly a device used for improving the putting stroke of a golfer.

CROSS-REFERENCE TO RELATED APPLICATION

This application is a nonprovisional patent application claiming the benefit of U.S. Provisional Application Ser. No. 60/253,002 filed on Nov. 27, 2000.

BACKGROUND OF THE INVENTION

Various devices are known in the prior art to assist a golfer in improving his or her putting stroke. These prior art devices employ a variety of holes, cups, or complex ramps; however, most are as large or larger than a standard golf hole and are thus cumbersome and not especially portable. Only a few of the prior art devices are designed for both aim and speed assessment. Further, none of these devices provide a portable and non-complex design to provide a practicing golfer with instant speed and alignment and assessment so that a very exact putt can be identified as an optimally putted ball. This type of assessment is important given close quarter putting practice where, currently, artificial holes are ineffective. The prior art devices do not provide a golfer with the necessary challenge needed for the transferring of putting practice skills from close quarter practicing areas to the actual putting green environments. In addition, prior art devices are designed to hug close to the turf or carpet whereby they are fixed from movement by an impacting putted ball and hence, the prior art devices can only be described as being non-interactive with artificial holes, cups or containers.

It has been discovered by those skilled in putting technology that controlling the speed of a putted ball can be as important as the alignment of the putt. Due to the varied slopes and nonuniform surface of the putting turf, it has been discovered that balls putted with a particular optimum speed will be less likely to prematurely break off the original putting alignment. This optimum force has been determined to be one which would cause a golf ball, when putted, to have sufficient speed to pass a golf hole between thirteen inches to twenty inches if missed.

It is also well known in putting practice that using a small putting target such as a coin or tee will assist a golfer in focusing alignment into a very narrow zone. By doing so, a golfer can obtain a greater alignment skill during indoor and close quarter practice. As stated earlier, these putting skills are necessary for their transfer onto an actual putting green environment.

Given the importance of the above noted speed and alignment requirements for putting practice, if follows that putting practice device would be greatly enhanced by incorporating in their design, a mechanism to identify both optimum speed and alignment of a putted ball.

The prior art also includes devices having artificial holes greater in size than the 4.25 inch hole found on an actual green. Such prior art devices are provided with lips or impediments which negate the ability of the prior art device to convey to the golfer a shot which, though not optimum, is still reasonably good. This is because the lip or impediment of such prior art devices extend beyond the diameter of a standard 4.25 inch hole and therefore project into the putting turf region beyond the hole. Accordingly, a put which may actually have gone into the hole is incorrectly read by such prior art devices as having missed the hole.

OBJECTS AND SUMMARY OF THE INVENTION

An object of the present invention is to provide a putting practice device in the form of a target and adapted for use both indoors and on a golf course green to assist a golfer in controlling both the speed and alignment aspects of putting.

It is a further object of this invention to provide an interactive practice device for a golfer that readily identifies the optimum force condition of a putted ball in indoor close quarter areas as well as on a golf course green environment.

Another object of this invention is to provide a practice device that can be approached from three hundred and sixty degrees.

A further object is to provide a practice device adapted to provide a golfer with a visual indication of a practice putt that would have been correctly aligned with the outside edge of a standard 4.25 inch hole as found on a golf green, the visual indication comprising tilting of the device following impact of a golf ball against the device.

Another object of the present invention is to provide a practice device that is adapted to be manufactured from a wide variety of materials.

Still another object of the present invention is to provide a practice device that avoids any rebound or bounce of the ball as the saucer comes to rest.

Yet another object of the present invention is to provide a practice device that identifies the force used on a ball putted by observing how far the ball may have rolled passed a hole in the event of a miss.

Another object of the present invention is to provide a practice device having a non-complex construction and sufficient portability so that the device may readily fit into a pants pocket, golf bag, desk drawer or other convenient region.

A further object of the invention is to provide a device which in at least one embodiment has a diameter that does not extend beyond the diameter of a standard golf hole and thereby simulates actual hole practice.

Yet still another object of the present invention is to provide a practice device adapted to instantly identify to the user a putt that is aligned precisely in the center of the putting target and thereby further facilitating indoor close quarter putting stroke development.

Another object of the present invention is to provide a practice device adapted to generate a very recognizable sound effect similar to that of the golf ball dropping into a cup disposed on an actual golf course green.

A further object of the present invention is to provide a practice device configured so that when user hits a golf ball having a ground speed at least sufficient to drop a putted ball into a standard sized golf hole on a standard 3/16th inch green turf or carpet, the impact of the ball against the leading edge of the device will noticeably cause a tilt the device thereby signaling to the user that the shot would likely be holed on an actual green notwithstanding the fact that it may not have struck the device in a perfectly centered manner.

In addition, another object of the device of the present invention is to provide a device adapted so that a golf ball putted with less than adequate speed or alignment and which correspondingly does not noticeably cause tilt of the device will convey to the user that such a shot was not properly made since the shot would not be likely to have entered a standard golf hole had the shot been made on an actual putting green during normal play.

In summary, the present invention is directed to a putting practice device adapted to assist a golfer in practicing putting almost anywhere desired, that is readily stored or transported and that is adapted to simulate actual hole practice as would be the case on an actual practice green.

These and other objects will be apparent from the following description and the drawings which are described as follows.

DETAILED DESCRIPTION OF THE PREFERRED EMBODIMENTS

Figure 1:
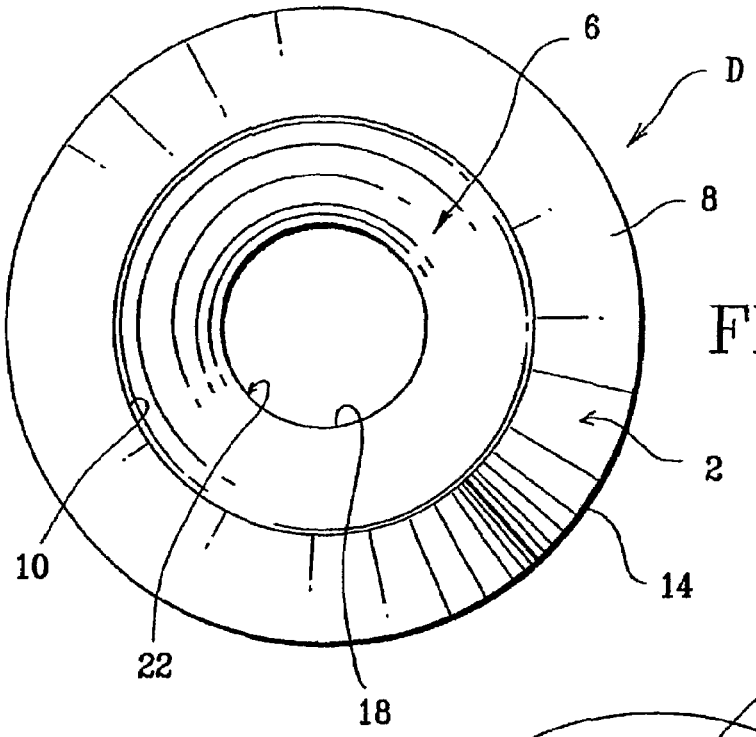
FIG. 1 is a top plan view of the golf putting practice device according to the present invention.
Figure 2:
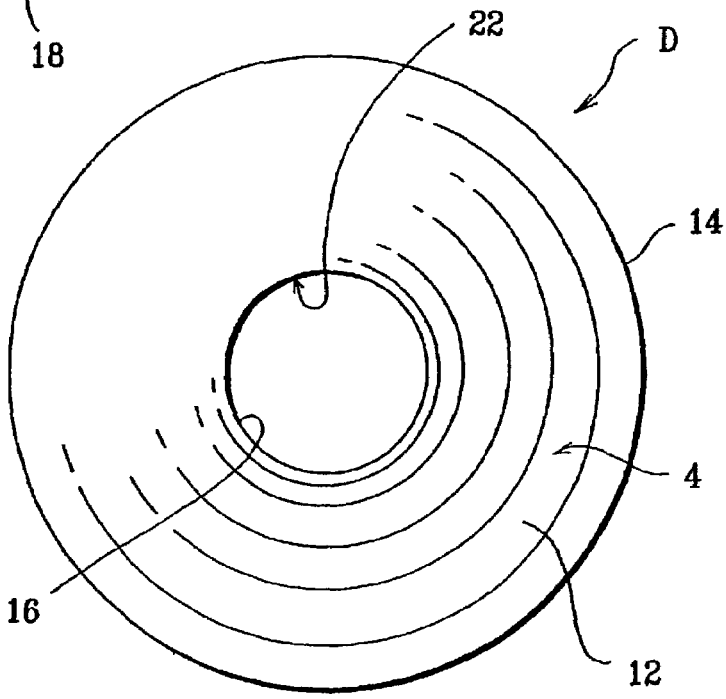
FIG. 2 is a bottom plan view of the golf putting practice device of the present invention.

As best shown in FIGS. 1 and 2, the golf putting practice device of the present invention comprises a disc D which includes an annular top portion 2 and an annular bottom portion 4. The annular top portion 2 includes a cup or opening 6 shown to have a concave configuration and a top edge 8. The annular bottom portion 4 includes a concave surface 12 which extends from the peripheral annular edge 14 to the bottom edge 16. The flat surface 8 extends from the annular peripheral edge 14 to the annular edge 10. The cup or opening 6 having a concave surface extends from annular edge 10 to bottom step edge 18, an inner step 20 extends from bottom edge 16 to bottom step edge 18. The disc D includes a central passageway 22 formed by annular edge 10 and bottom step edge 18 and bottom edge 14.

Figure 3:
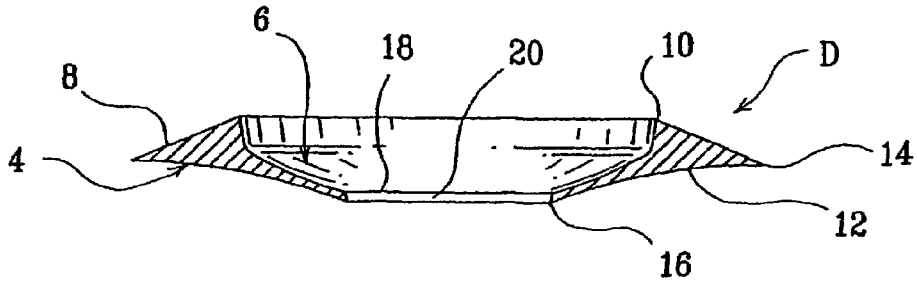
FIG. 3 is cross-sectional side elevational view of the golf putting practice device shown in FIGS. 1 and 2 and supported on a putting surface.

In at least one embodiment of the invention shown in FIGS. 1 through 3, the disc D will have an overall diameter from about of three inches to about four inches and preferably about 3.586 inches. The central passageway 22 at the annular top edge 10 has a diameter of about two inches to about two and a half inches and preferably about 2.305 inches. The central passageway 22 at the bottom step edge 18 and the bottom edge 16 has a diameter of from about one inch to about 1.20 inches and preferably about 1.152 inches. The height of the disc D is from about 0.3 inch to about 0.5 inch and preferably about 0.442 inches. The flat surface 8 has an angle from about 17° to about 21° with a preferably angle of about 19°.

A further alternative embodiment of the practice device is shown in FIGS. 7 through 10 and includes a disc D having a step or base 24 which engaged the carpet or turf T. In this embodiment of the practice device the disc D has an annular top portion 26 and an annular bottom portion 28. The annular top portion 26 has a flat surface 29 and an top edge 30. The annular bottom portion 28 has a flat surface 32 which extends from the peripheral annular edge 34 to the bottom edge 36. The flat surface 29 extends from the annular peripheral edge 34 to the annular edge 30. A center cup or opening 42 extends vertical from annular edge 30 to central edge 38 to central step edge 37 and bottom edge 36. An inner step 40 extends from bottom edge 36 to central step edge 37. The disc D in the embodiment shown in FIGS. 7 through 10 has an overall diameter from about three inches to about four inches and preferably about 3.586 inches. The center cup or opening 42 at the annular top edge 30 has a diameter of about two inches to about two and a half inches and preferably about 2.305 inches. The center cup or opening 42 at the inner step 40 has a diameter of from about one inch to about 1.20 inches and preferably about 1.152 inches. The disc D will have a height from about 0.3 inch to about 0.5 inch and preferably about 0.442 inch. The flat surface 28 has an angle from about 17° to about 21° with a preferable angle of about 19°.

In a preferred design of the present invention, the disc is simply provided with a leading or peripheral edge 14 in the manner as set forth above and configured so as to cause a tilt of the device upon impact of the edge with a golf ball. In an additional preferred design of the present invention, the device will include not only the leading edge configured in the manner as set forth above but also include the center cup adapted to catch and retain a putted ball traveling at a desired velocity or speed.

Figure 4:
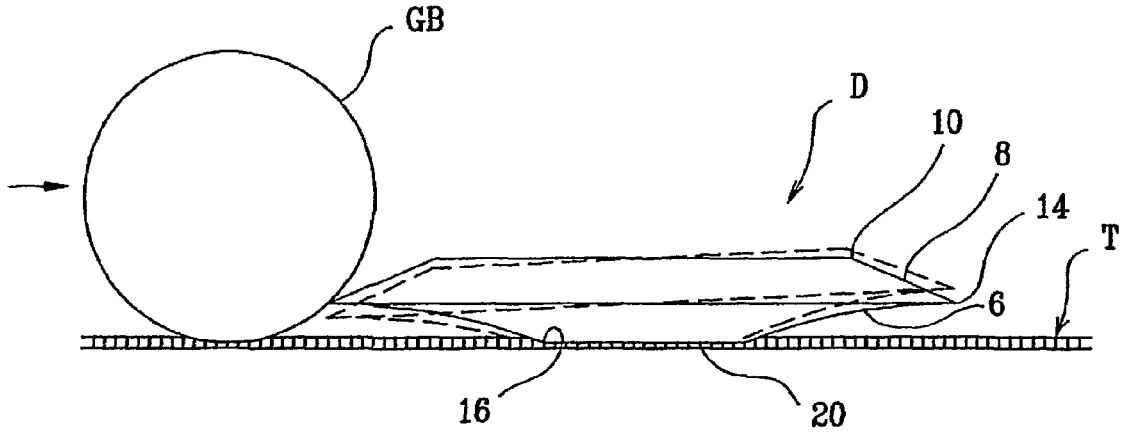
FIG. 4 is side elevational view of a golf ball impacting the golf putting practice device of the present invention with tilt shown in phantom lines.
Figure 5:
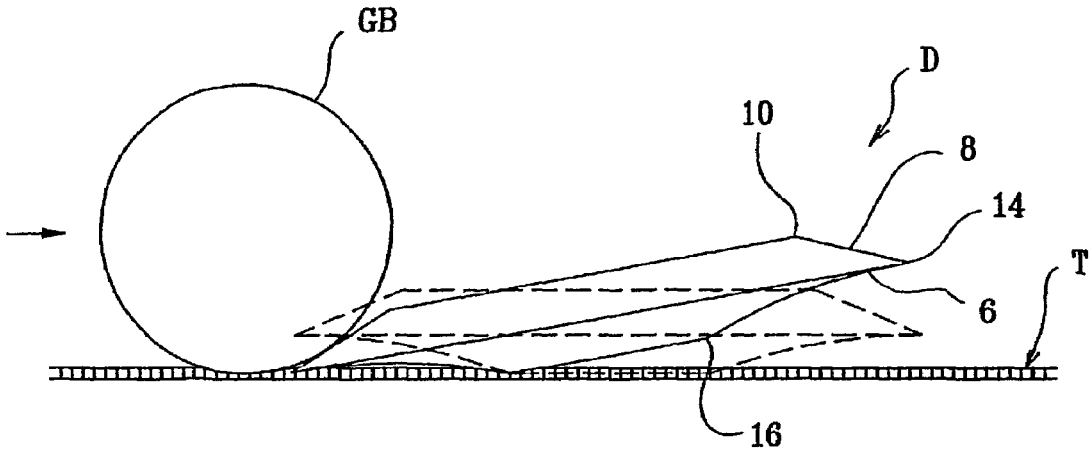
FIG. 5 is side elevational view of a golf ball rolling on the top portion of the golf putting practice device, initial non-tilt shown in phantom lines.
Figure 6:
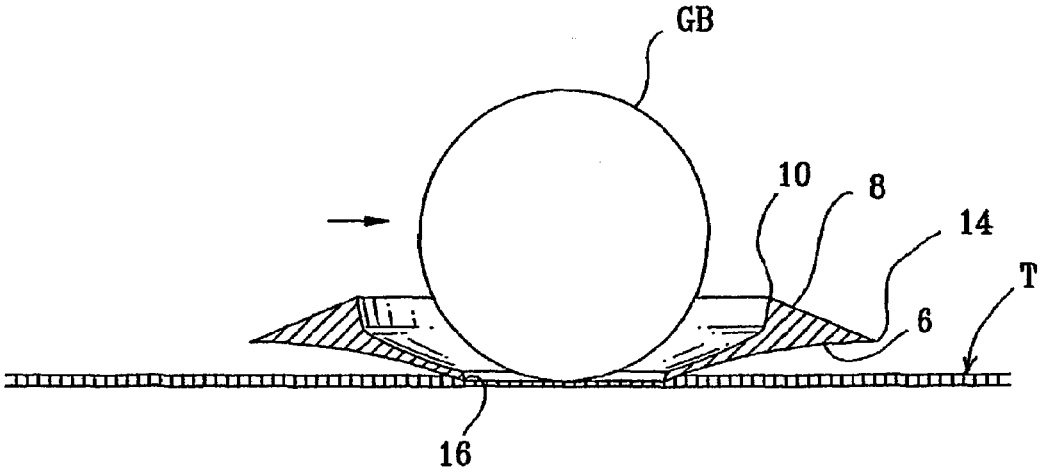
FIG. 6 is a cross-sectional side elevational view of the golf putting practice device and showing a golf ball resting in the central opening of the device.
Figure 7:
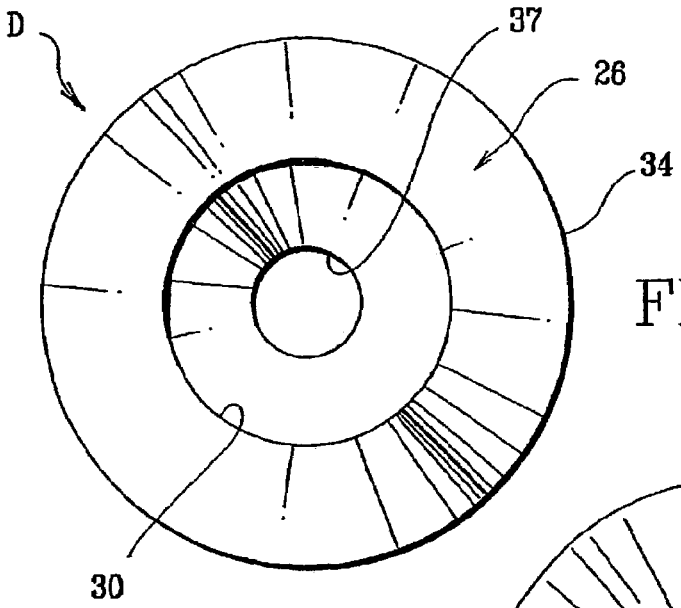
FIG. 7 is a top plan view of an alternative embodiment of the device according to the present invention.
Figure 8:
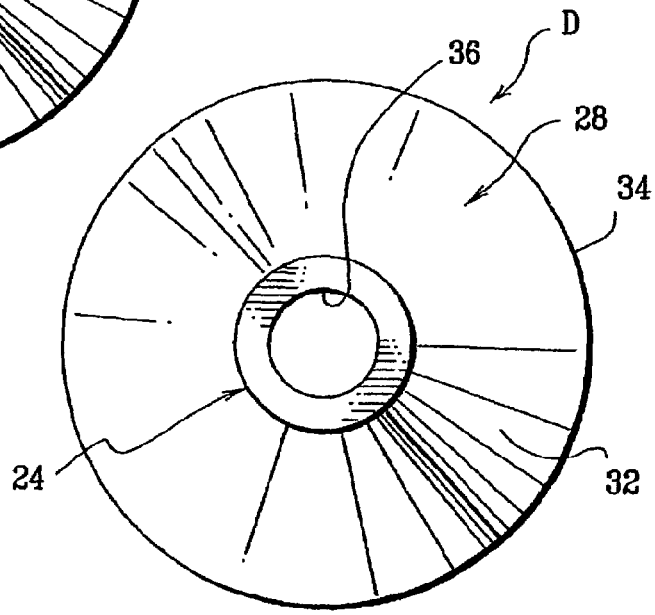
FIG. 8 is a bottom plan view of the golf putting practice device shown in FIG. 7.
Figure 9:
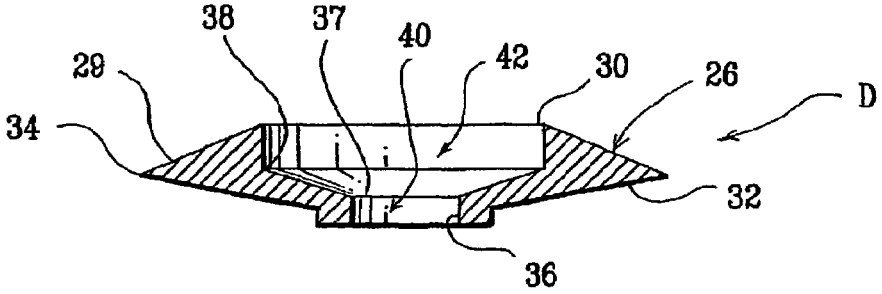
FIG. 9 is a cross-sectional side elevational view of the golf putting practice device shown in FIGS. 6 and 7 and supported on a putting surface.
Figure 10:
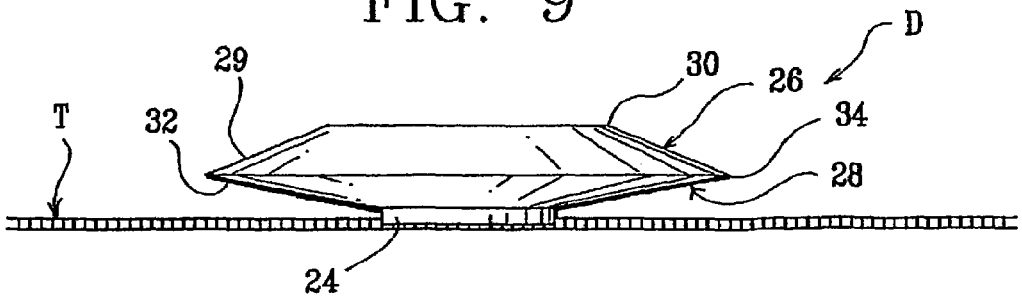
FIG. 10 is a side elevational view of the golf putting practice device shown in FIGS. 6 through 9.

Operation of all the above identified embodiments is essentially the same and is best shown in FIGS. 4, 5 and 6 wherein a disc D is shown positioned on a putting surface T and when an golf ball GB is caused to impact against the peripheral edge 14 (or 30) with optimum speed and alignment, it is caused to roll up the flat surface 8 (or 28) and into the central opening 22 (or 42). The embodiment shown in FIGS. 7 through 10 is provided with step 24 so that an impacting golf ball GB cannot push or otherwise slide the practicing practice device backwards along the turf T or carpet and thus the forward motion and rotation force of the ball is sufficient to roll up the outer annular peripheral edge 34 and into opening center 42 of the device D and create a sound similar to that of a golf ball dropping into a cup on an actual golf course green.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A golf putting practice device comprising:

a) a bottom, said bottom adapted to support said device when placed on a surface;

b) a top, said top connected to said bottom to provide a leading perimeter edge having a generally circular configuration;

c) a central opening, said central opening extending through each of said top and said bottom, said central opening at said top having a diameter substantially greater than said central opening at bottom; and d) at least a portion of said bottom adjacent said perimeter edge is slanted so that when a rolling golf ball comes into contact with said perimeter edge, said device is cause to be tilted.

2. A device as in claim 1 and wherein said disc has a height less than half that of a regulation golf ball.

3. A device as in claim 1 and wherein:

a) each of said top and said bottom having at least one of a planar or concave surface configuration.

4. A device as in claim 1 and further including:

a) a step member, said step member extending from said bottom and adapted to support said device when placed on a surface.

* * * * *